United States Patent [19]

Laule et al.

[11] 4,088,462

[45] May 9, 1978

[54] HOT-WATER EXTRACTION UNIT

[75] Inventors: Thomas M. Laule, Sparks; R. Eugene Blackman, Reno, both of Nev.

[73] Assignee: Parise & Sons, Inc., Reno, Nev.

[21] Appl. No.: 690,821

[22] Filed: May 27, 1976

[51] Int. Cl.[2] ..... B01D 45/08

[52] U.S. Cl. ..... 55/437; 15/353; 55/467

[58] Field of Search ..... 15/320, 321, 353; 55/442, 443, 465, DIG. 3, 437, 467

[56] References Cited

U.S. PATENT DOCUMENTS

| | | | |
|---|---|---|---|
| 2,673,619 | 3/1954 | Martin | 15/353 X |
| 3,048,875 | 8/1962 | Bottinelli et al. | 15/353 X |
| 3,131,417 | 5/1964 | Compton | 15/353 |
| 3,663,985 | 5/1972 | Burgoon | 15/353 |
| 3,896,521 | 7/1975 | Parise | 15/321 |
| 3,911,524 | 10/1975 | Parise | 15/353 |

*Primary Examiner*—Christopher K. Moore
*Attorney, Agent, or Firm*—Sughrue, Rothwell, Mion, Zinn and Macpeak

[57] ABSTRACT

The specification discloses a hot-water extraction unit of the type commonly referred to as a "steam cleaner". The vacuum tank of the unit is vertically divided into substantially separate first, second, third, and fourth volumes by a deflector divider. The vacuum wand communicates with the first volume, the first volume communicates with the second volume by an aperture at the bottom of the deflector divider, the second volume communicates with the third volume by an aperture at the bottom of the deflector divider, the third volume communicates with the fourth volume by an aperture in the deflector divider, and the riser pipe is located in the fourth volume.

13 Claims, 4 Drawing Figures

FIG. 1
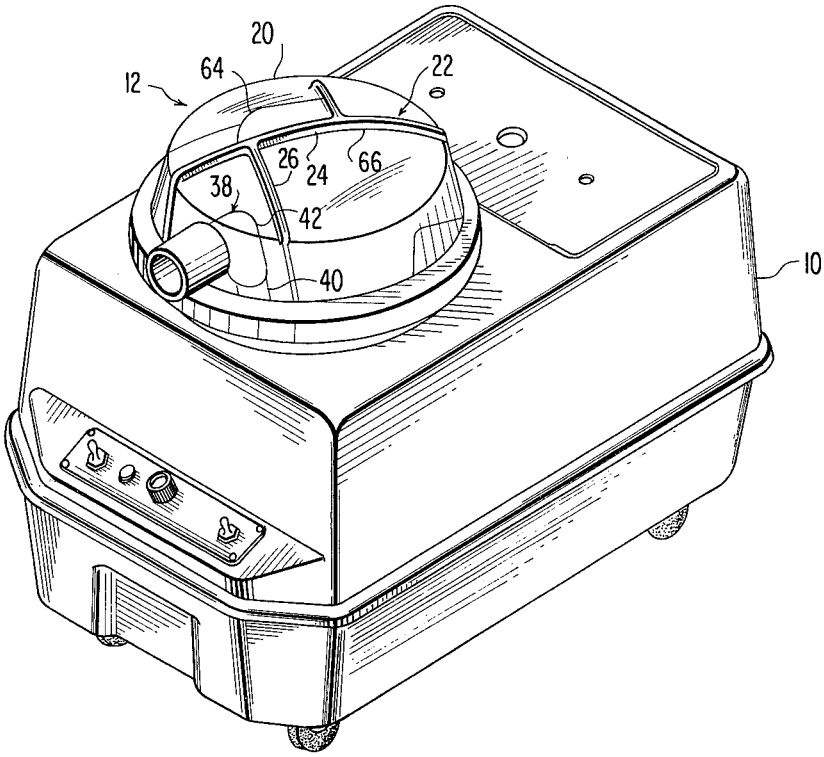
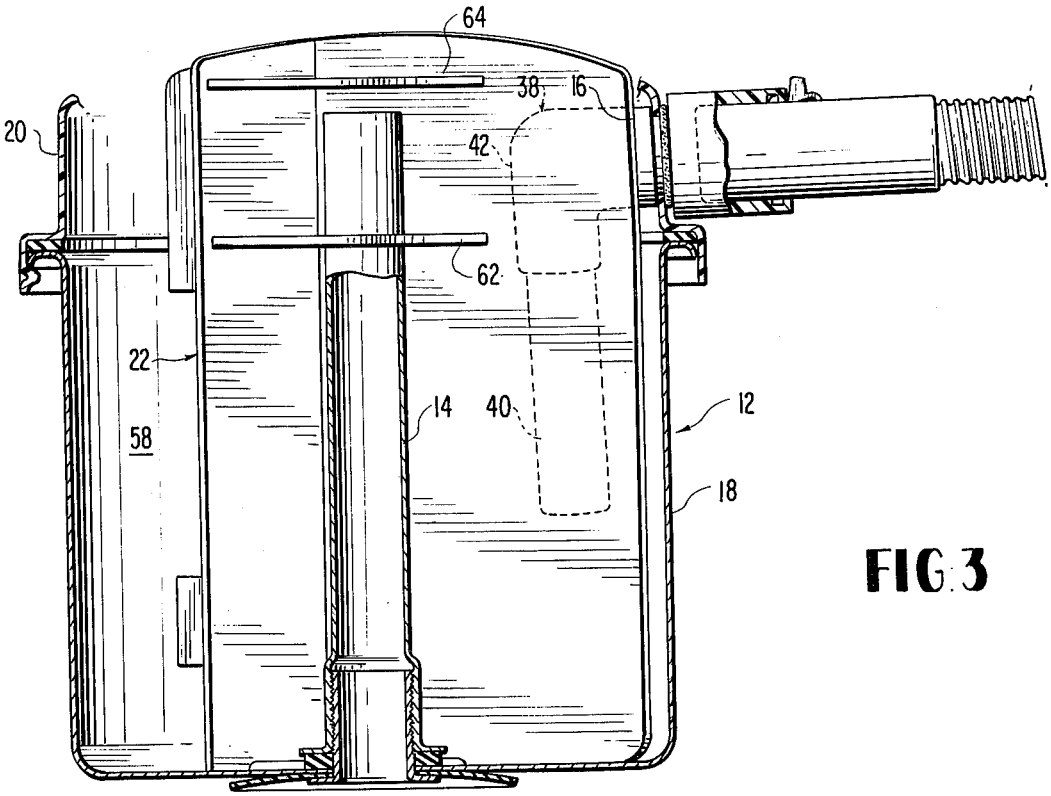
FIG. 3

HOT-WATER EXTRACTION UNIT

FIELD OF THE INVENTION

This invention is an apparatus for cleaning rugs, upholstery, and the like which is especially adapted for non-commercial use, as in the home.

DESCRIPTION OF THE PRIOR ART

This invention is an improvement on the device shown in U.S. Pat. No. 3,896,521, issued July 29, 1975.

SUMMARY OF THE INVENTION

The invention is a hot-water extraction unit of the type commonly referred to as a "steam cleaner". The vacuum tank of the unit is vertically divided into substantially separate first, second, third, and fourth volumes by a deflector divider. The vacuum wand communicates with the first volume, the first volume communicates with the second volume by an aperture at the bottom of the deflector divider, the second volume communicates with the third volume by an aperture at the bottom of the deflector divider, the third volume communicates with the fourth volume by an aperture in the deflector divider, and the riser pipe is located in the fourth volume.

BRIEF DESCRIPTION OF THE DRAWINGS

FIG. 1 is a perspective view of the preferred embodiment of the subject invention.

FIG. 3 is a view along the line 3—3 in FIG. 2.

DETAILED DESCRIPTION OF THE PREFERRED EMBODIMENT

Figure 2:
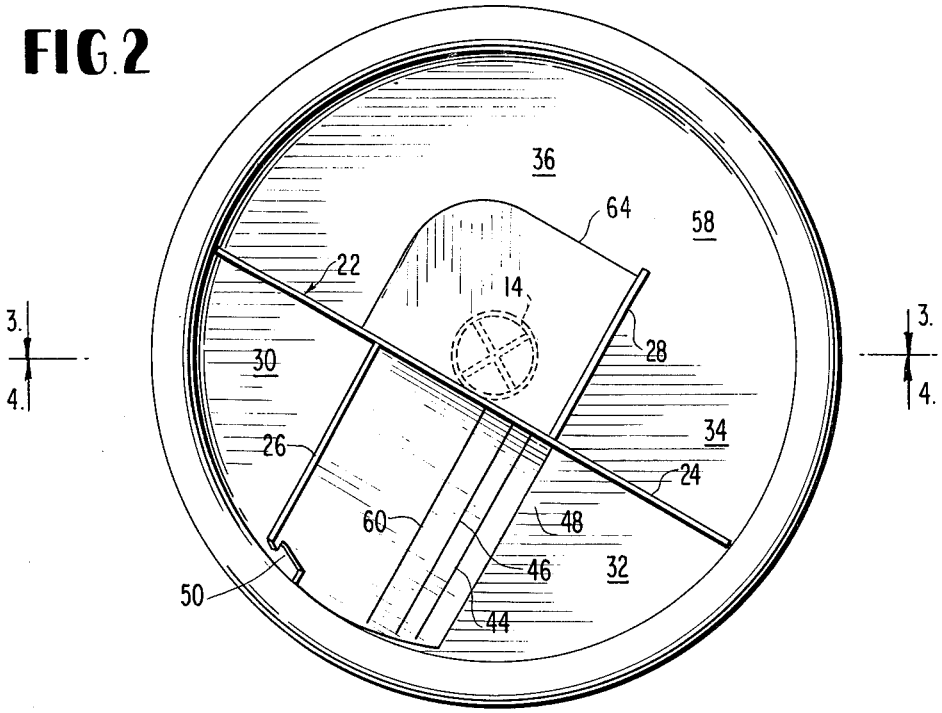
FIG. 2 is a plan view of the dump tank used with the embodiment shown in FIG. 1.
Figure 4:
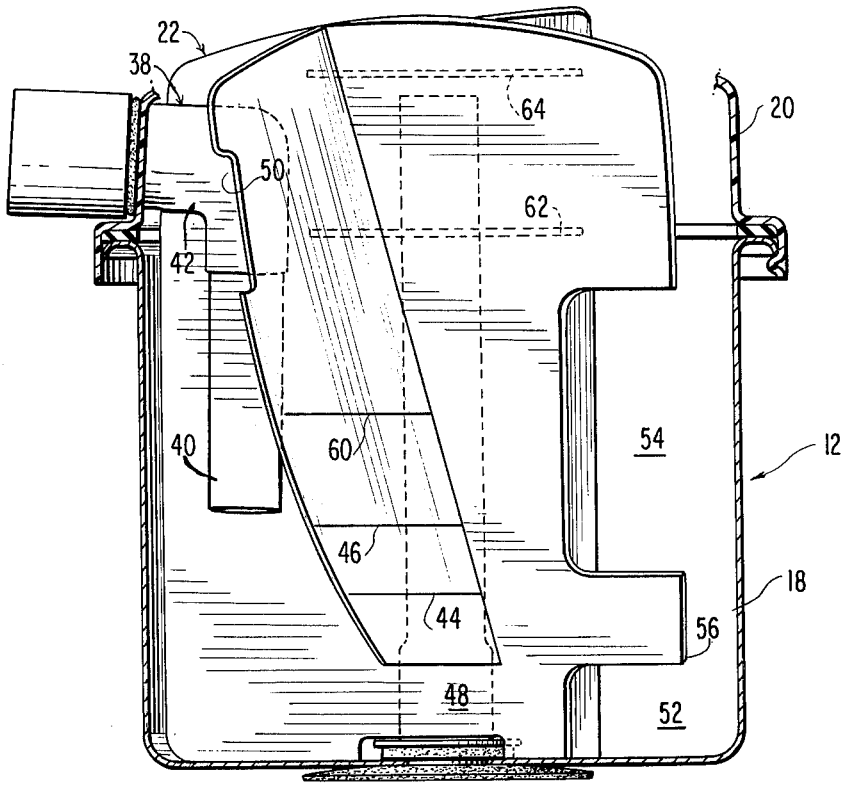
FIG. 4 is a view along the line 4—4 in FIG. 2.

Since the device shown in the drawings is a direct descendent of the device shown in U.S. Pat. No. 3,896,521, issued July 29, 1975, this description will emphasize the differences between the two devices rather than describing the overall device in detail. However, in brief, the device disclosed herein (as well as the device disclosed in the earlier patent) comprises a body 10, a vacuum tank 12 mounted in the body 10, a hollow riser pipe 14 mounted on the bottom of the vacuum tank 12 and having an opening near the top thereof providing communication between the interior of the hollow riser pipe 14 and the interior of the vacuum tank 12, means (not shown) for creating a vacuum in the hollow riser pipe 14, and an aperture 16 in the vacuum tank 12 near the top thereof for communicating vacuum therefrom to the exterior of the vacuum tank 12. During use of the machine, the vacuum would of course be communicated through the aperture 16 to a vacuum wand (not shown). The vacuum tank 12 comprises a lower cup-shaped member 18 made of steel and an upper cup-shaped lid 20 made of transparent plastic. In this respect the device is more like the one shown in U.S. Pat. No. 3,911,524, issued Oct. 14, 1975, than it is like the device shown in the previously cited patent.

The device shown herein and the device shown in U.S. Pat. No. 3,896,521 also both contain a deflector divider 22 removably mounted in the vacuum tank 12 between the aperture 16 and the riser pipe 14 and comprising a divider plate 24 and a first deflector plate 26. The divider plate 24 is in height approximately equal to the interim height of the vacuum tank 12, in width approximately equal to the distance from one inner wall of the vacuum tank 12 to the opposite wall taken along a line passing adjacent to the exterior of the riser pipe 14 on the side thereof facing towards the aperture 16, and has at least one aperture for the passage of water and/or air near its bottom. The first deflector plate 26 is attached to the divider plate 24 approximately perpendicularly to its surface on the side thereof facing towards the aperture 16, and it is mounted at a small angle to the vertical such that it slopes away from the aperture 16. The first deflector plate 26 is in width approximately equal to the distance from the divider plate 24 to the adjoining wall of the vacuum tank 12, and it extends from approximately the top of the divider plate 24 to a short distance above the botom of the divider plate.

In the subject device, as contrasted to the prior device, the deflector divider 22 also comprises a second deflector plate 28 attached to the divider plate 24 approximately perpendicularly to its surface on the side thereof facing away from the aperture 16 and on the side of the riser pipe 14 remote from the aperture 16. The second deflector plate 28 extends from approximately the top of the divider plate 24 to approximately the bottom thereof and from the divider plate 24 past the riser pipe 14, but it does not extend to the opposite wall of the vacuum tank 12.

The divider plate 24, the first deflector plate 26, and the second deflector plate 28 vertically divide the interior of the vacuum tank 12 into substantially separate volumes 30, 32, 34, and 36 (see FIG. 2). The aperture 16 leads into the volume 30, the volume 30 communicates with the volume 32, the volume 32 communicates with the volume 34, the volume 34 communicates with the volume 36, and the riser pipe 14 is located in the volume 36. In contrast to the device shown in U.S. Pat. No. 3,896,521, there is no aperture in the divider plate 24 on the same side of the first deflector plate 26 as the aperture 16. Accordingly, the flow of incoming dirty water, foam, and air is, on the average, unidirectional in plan, the direction being counterclockwise in FIG. 2. (Of course, there is a good deal of local turbulence, particularly in volume 30, and vertical movement, particularly of the air.)

A hollow coupling pipe 38 the inner opening of which is pointed towards the bottom of the vaccum tank 12 is mounted in the aperture 16 in both the subject device and in the prior device. However, in the subject device the coupling pipe 38 may be adapted to extend down into the vacuum tank by a distance more than half the distance between the aperture 16 and the bottom of the vacuum tank 12. This is accomplished by the provision of a coupling pipe extension tube 40 which screws into the upper portion 42 of the coupling pipe 38. The extension tube 40 is used only when the device is being used for dry vacuuming; when it is being used for wet vacuuming or hot-water extraction it is removed, and the coupling pipe 38 functions in the same way as the coupling pipe in the prior device.

During use of the device, the speed of the incoming dirt and air (when the device is being used as a dry vacuum) or of the incoming dirt, air, and water (when the device is being used as a wet vacuum or as a hot-water extraction unit) causes a great deal of turbulence in volume 30. In the former case, the vacuum tank 12 is first partly filled with water (to a level between the lines 44 and 46) to act as a filtering medium, and in the latter two cases water is one of the influents, so there is always a turbulent mixture of dirty water, spray, and air in volume 30 during use of the device. If that turbulence got around to volume 36, it would tend to cause dirt and/or water to go down the riser pipe 14, and it is the function of the deflector divider 22 to keep that from happening.

The divider plate 24 and the first deflector plate 26 deflect incoming foreign matter to a segment of the bottom of the vacuum tank 12 defined by the adjoining faces of the divider plate 24 and the first deflector plate 26. There the water bubbles through the aperture 48 beneath the bottom of the first deflector plate 26. A second aperture 50 is provided in the first deflector plate 26 near its top for the passage of air and, to some extent, spray. In the absence of the aperture 50, the air would also pass through the aperture 48; however, it would create a highly undesirable amount of turbulence in the chamber 32.

The end of the divider plate 24 defining the barrier between the volume 30 and the volume 32 has a relatively small, radially outward aperture 52 and the bottom of the divider plate 24 and a relatively large, radially outward aperture 54 near the middle of the divider plate 24. Again, the water passes mostly through the aperture 52 and the air passes mostly through the aperture 54. Experiments with earlier versions of this device have indicated that the tongue of material 56 between the apertures 52 and 54 has some important function in quieting the turbulence of the water, but what that function is is not currently understood.

The fact that the second deflector plate 28 does not extend all the way out to the wall of the vacuum tank 12 provides essentially one large aperture 58 between the wall of the vacuum tank 12 and the radially outward end of the second deflector plate 28 through which the now substantially quieted water and air flows into the volume 36.

The water tends to collect in the volume 36, although of course the force of gravity and the tendency of water to seek a uniform level ensures that water will remain in the other three volumes even when the device is being used as a dry vacuum (that is, when there is no water coming into the device through the aperture 16). The line 60 on the first deflector divider 26 indicates the maximum level to which water should be allowed to accumulate in the volume 32 before emptying the dump tank 18. When the water reaches the level 60 in the volume 32 and the vacuum is on, the water level in the volume 36 will be somewhat higher than the water level in the volume 32.

Although a defoaming agent is supposed to be put in the vacuum tank 12 before the device is used as a hot-water extraction unit and when it is likely to pick up soap particles from previous rug shampooings, that precaution is not always observed by users of the device. When it is not, foam is likely to accumulate in the vacuum tank 14, particularly in the volume 36. Such foam is highly frivolous and has a pronounced tendency to work its way up the sides of the riser pipe 14, whence it is drawn into the opening at the top of the riser pipe 14 and down into the vacuum motor (not shown). Ultimately, a passage of a great deal of foam into the vacuum motor can adversely effect the motor. Accordingly, a third deflector plate 62 is provided which has an opening sized to receive the riser pipe 14 snugly, and means are provided for holding the third deflector plate 62 in position a short distance below the top of the riser pipe 14. In the preferred embodiment shown in the drawings, the third deflector plate 62 is attached horizontally to the divider plate 24 and the second deflector plate 28 perpendicularly to the surface of the divider plate on the side of the deflector plate 24 adjacent to the riser pipe 14, and the third deflector plate 62 is sized to extend from the divider plate 24 and the second deflector plate 28 past the riser pipe 14 but not to the sides of the vacuum tank 14. However, the third deflector plate 62 serves the same function in this regard as the strut 42 shown in U.S. Pat. No. 3,911,524, and the great difference in appearance between the third deflector plate 62 herein and the strut 42 in that patent illustrate the great variety in shapes which this element can take.

The inside of the lid 20 is relatively flat immediately above the riser pipe 14, and it was found, with experimental models of the device, that water droplets sometimes formed there and then dropped into the riser pipe 14. To prevent that from occurring, a drip plate 64 is provided in the vacuum tank 12 over the opening in the riser pipe 14. The drip plate 64 may be shaped and mounted so that its bottom slopes downwardly away from the top of the riser pipe 14, allowing droplets of condensation to run down to the edge of the drip plate 64 before they drop off and into the water below. In the presently preferred embodiment, the drip plate 64 has a flat bottom surface, it is attached to the divider plate 24 and the second deflector plate 28 so as to lie horizontal on the side of the second deflector plate 28 adjacent to the riser pipe 14, and it extends from the divider plate 24 and the second deflector plate 28 out over the opening in the riser pipe a short distance above the opening.

Grooves 66 are formed in the inner surface of the lid 20 to receive the tops of the divider plate 24 and the first and second deflector plates 26 and 28. These grooves have two important functions. First, they insure that the lid 20 can only be put on the dump tank 18 in the desired relationship to the riser pipe 14 — that is, they insure that the riser pipe 14 will always be in the volume 36 before the lid can be brought down onto the dump tank 18 in airtight engagement therewith. Second, the cooperation of the grooves 66 and the top of the deflector divider 22 provides a simple labyrinth seal, substantially reducing the amount of air and spray which can get between the bottom of the lid 20 and the top of the deflector 22, departing from the desired flow path for the fluids.

CAVEAT

While the present invention has been illustrated by a detailed description of a preferred embodiment thereof, it will be obvious to those skilled in the art that various changes in form and detail can be made therein without departing from the true scope of the invention. For that reason, the invention must be measured by the claims appended hereto and not by the foregoing preferred embodiment.

What is claimed is:

1. In a combination vacuum and hot liquid cleaner comprising:

(a) a body;

(b) a vacuum tank mounted in said body;

(c) a hollow riser pipe mounted on the bottom of said between the interior of said hollow riser pipe and the interior of said vacuum tank;

(d) first means for creating a vacuum in said hollow riser pipe;

(e) an aperture in said vacuum tank near the top thereof for communicating vacuum therefrom to the exterior of said vacuum tank; and (f) a deflector divider mounted in said vacuum tank between said aperture and said riser pipe, said deflector divider comprising:

(i) a divider plate extending generally parallel to said riser pipe and adjacent thereto and being in height approximately equal to the interior height of said vacuum tank, and in width, approximately equal to the distance from one inner wall of said vacuum tank to the opposite wall taken along a line passing adjacent to the exterior of said riser pipe on the side thereof facing towards said aperture, and having at least one aperture therein near the bottom thereof, whereby said divider plate substantially inhibits but does not prevent passage of foreign matter from one side to the other of said divider plate, and (ii) a first deflector plate attached to said divider plate approximately perpendicularly to the surface of said divider plate on the side thereof facing towards said aperture in said vacuum tank, said first deflector plate being mounted at a small angle to the vertical such that it slopes away from said aperture in said vacuum tank, said first deflector plate being in width approximately equal to the distance from said divider plate to the adjoining wall of said vacuum tank and extending from approximately the top of said divider plate to a short distance above the bottom of said divider plate, whereby foreign matter introduced into said vacuum tank through said aperture in said vacuum tank is deflected to a segment of the bottom volume of said vacuum tank defined by the adjoining faces of said divider plate and said first deflector plate, the improvement wherein said deflector divider further comprises a second deflector plate attached to said divider plate approximately perpendicularly to the surface of said divider plate on the side thereof facing away from said aperture in said vacuum tank and on the side of said riser pipe remote from said aperture in said vacuum tank, said second deflector plate extending from approximately the top of said divider plate to approximately the bottom thereof and from said divider plate past said riser pipe, but not extending to the opposite wall of said vacuum tank, whereby said second deflector plate inhibits but does not prevent passage of foreign matter from one side to the other of said second deflector plate.

2. In a combination vaccum and hot liquid cleaner as recited in claim 1, the further improvement wherein said second deflector plate is approximately vertical.

3. In a combination vacuum and hot liquid cleaner as recited in claim 1, the further improvement wherein said divider plate is non-apertured on the same side of said first deflector plate as said aperture in said vacuum tank.

4. In a combination vacuum and hot liquid cleaner as recited in claim 1 wherein said vacuum tank comprises a lower cup-shaped member and a lid adapted to fit on said lower cup-shaped member in air-ight engagement therewith, the improvement wherein grooves are formed in the inner surface of said lid to receive the tops of said divider plate and said first and second deflector plates.

5. In a combination vacuum and hot liquid cleaner as recited in claim 1 wherein a hollow coupling pipe is mounted in said aperture in said vacuum tank and projects into the interior of said vacuum tank, the opening of said coupling pipe within said vacuum tank being pointed towards the bottom of said vacuum tank, the further improvement wherein said coupling pipe extends down into said vacuum tank by a distance more than half the distance between said aperture in said vacuum tank and the bottom of said vacuum tank.

6. In a combination vacuum and hot liquid cleaner as recited in claim 5, the further improvement wherein said hollow coupling pipe is made in two disconnectable parts, one of which is mounted in said aperture in said vacuum tank and has an opening pointed towards the bottom of said vacuum tank at a height only slightly below the height of said aperture in said vacuum tank and the other of which, when connected to the first part, extends said hollow coupling pipe down into said vacuum tank by the previously recited amount.

7. In a combination vacuum and hot liquid cleaner as recited in claim 1, the further improvement comprising a drip plate attached to said divider plate and said second deflector plate on the side of said deflector plate adjacent to said riser pipe and extending from said divider plate and said second deflector plate and over the opening in said riser pipe and being spaced a short distance above the opening, near the top thereof.

8. In a combination vacuum and hot liquid cleaner as recited in claim 1, the further improvement comprising a third deflector plate attached to said divider plate and said second deflector plate perpendicuarly to the surface of said divider plate on the side of said second deflector plate adjacent to said riser pipe, said third deflector plate having an opening therein snugly receiving said riser pipe a short distance below the opening in said riser pipe and extending from said divider plate and said second deflector plate past said riser pipe but not to the sides of said vacuum tank.

9. In a combination vacuum and hot liquid cleaner as recited in claim 8, the further improvement wherein said third deflector plate is horizontal.

10. In a combination vacuum and hot liquid cleaner comprising:

(a) a body;

(b) a vacuum tank mounted in said body;

(c) a hollow riser pipe mounted on the bottom of said vacuum tank and having an opening near the top thereof providing communication between the interior of said hollow riser pipe and the interior of said vacuum tank;

(d) first means for creating a vacuum in said hollow riser pipe; and (e) an aperture in said vacuum tank near the top thereof for communicating vacuum therefrom to the exterior of said vacuum tank;

the improvement comprising a deflector divider mounted in said vacuum tank and shaped to vertically divide the interior of said vacuum tank into substantially separate first, second, third, and fourth volumes, said aperture in said vacuum tank leading into said first volume, a first deflector divider aperture within the portion of the deflector divider communicating said first volume with said second volume and being formed at the bottom of said deflector divider, a second deflector divider aperture at the bottom of said deflector divider within the portion of the deflector divider communicating said second volume with said third volume, a third deflector divider aperture within the portion of said deflector divider communicating said third volume with said fourth volume, and wherein said riser pipe is located within said fourth volume.

11. In a combination vacuum and hot liquid cleaner comprising:

(a) a body;

(b) a vacuum tank mounted in said body, said vacuum tank comprising a lower cup-shaped member and a lid adapted to fit on said lower cup-shaped member in air-tight engagement therewith;

(c) a hollow riser pipe mounted on the bottom of said vacuum tank and having an opening near the top thereof providing communication between the interior of said hollow riser pipe and the interior of said vacuum tank;

(d) first means for creating a vacuum in said hollow riser pipe;

(e) an aperture in said vacuum tank near the top thereof or communicating vacuum therefrom to the exterior of said vacuum tank; and (f) a deflector divider formed of intersecting plates mounted in said vacuum tank and shaped to vertically divide the interior of said vacuum tank into at least two substantially separate volumes, the improvement wherein grooves are formed in the inner surface of said lid to receive the top of said deflector divider plates.

12. In a combination vacuum and hot liquid cleaner as recited in claim 11 wherein a hollow coupling pipe is mounted in said aperture in said vacuum tank and projects into the interior of said vacuum tank, the opening of said coupling pipe within said vacuum tank being pointed towards the bottom of said vacuum tank, the further improvement wherein said coupling pipe extends down into said vacuum tank by a distance more than half the distance between said aperture in said vacuum tank and the bottom of said vacuum tank.

13. In a combination vacuum and hot liquid cleaner as recited in claim 12, the further improvement wherein said hollow coupling pipe is made in two disconnectable parts, one of which is mounted in said aperture in said vacuum tank and has an opening pointed towards the bottom of said vacuum tank at a height only slightly below the height of said aperture in said vacuum tank and the other of which, when connected to the first part, extends said hollow coupling pipe down into said vacuum tank by the previously recited amount.

* * * * *